US005429370A

United States Patent [19]

Binder

[11] Patent Number: 5,429,370

[45] Date of Patent: Jul. 4, 1995

[54] MILL GAME

[76] Inventor: Henry Binder, 9207 Inkster Rd., Livonia, Mich. 48150

[21] Appl. No.: 159,726

[22] Filed: Nov. 30, 1993

[51] Int. Cl.[6] ..... A63F 3/00

[52] U.S. Cl. ..... 273/264

[58] Field of Search ..... 273/264, 271

[56] References Cited

U.S. PATENT DOCUMENTS

| | | | |
|---|---|---|---|
| 1,499,214 | 6/1924 | Griebel | 273/264 |
| 1,529,132 | 3/1925 | Jimison | 273/264 |
| 1,760,642 | 5/1930 | Graham | 273/271 |
| 4,063,734 | 12/1977 | Taylor | 273/264 |
| 4,579,347 | 4/1986 | Reman | 273/264 |
| 4,852,887 | 8/1989 | Li | 273/264 |

*Primary Examiner*—William H. Grieb
*Attorney, Agent, or Firm*—Bliss McGlynn

[57] ABSTRACT

A Mill game includes a game board having a playing surface, a plurality of game piece locations on the playing surface and arranged in a manner defining concentric rectangles, a plurality of lines interconnecting the game piece locations and a plurality of game pieces for movement along the lines between the game piece locations.

2 Claims, 1 Drawing Sheet

FIG 1
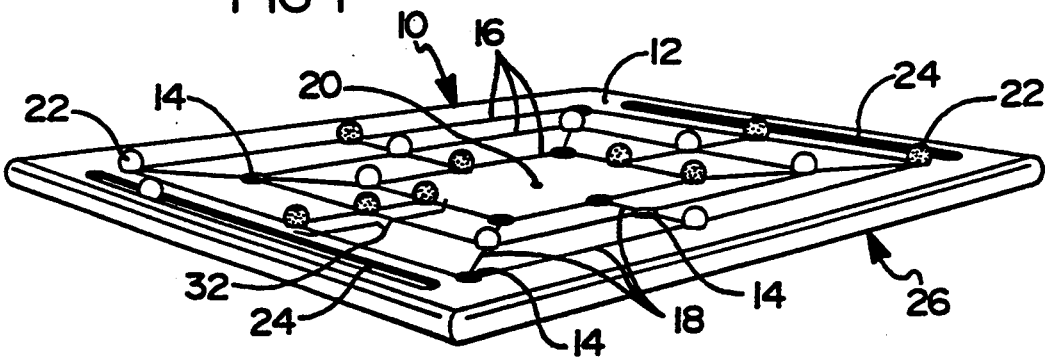
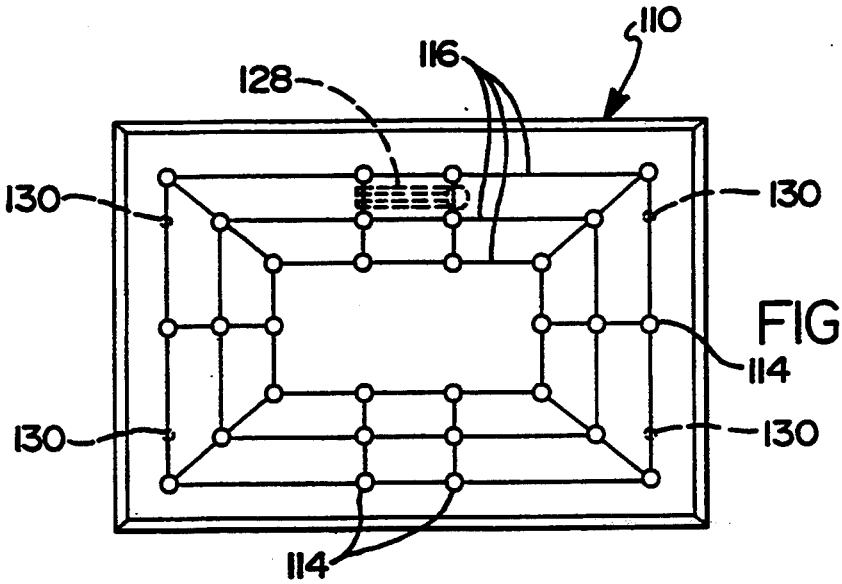
FIG 2
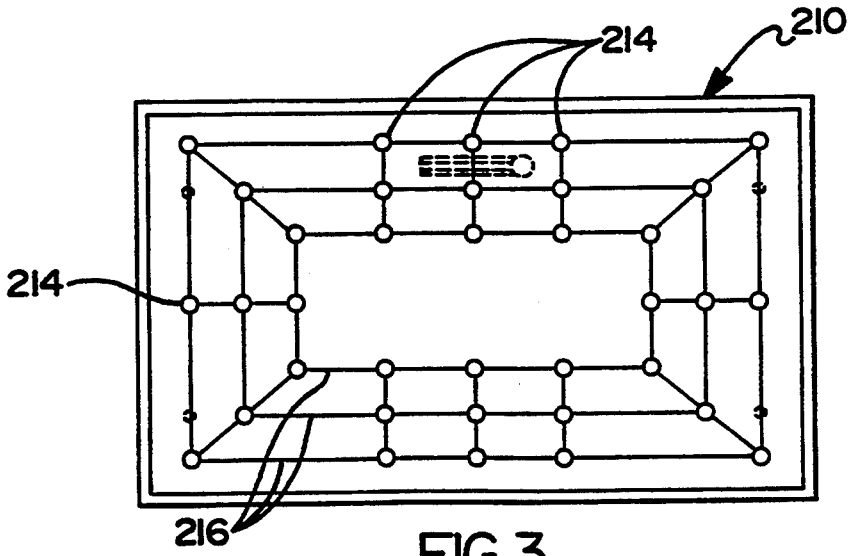
FIG 3

MILL GAME

BACKGROUND OF THE INVENTION

1. Field of the Invention

The present invention relates generally to a game and, more specifically, to a Mill game.

2. Description of the Related Art

Popular board games like checkers and chess involve competition between players; i.e., each player attempts to gain control of the board through strategic moves of individual game pieces. These games require each player to plan moves in advance while at the same time trying to anticipate and counter their opponents moves. Such games stimulate the mind and require logical thinking at the same time.

Another game involving competition between players is called a Mill game. The game includes a fixed number of game pieces positioned and moved about a playing surface. The object of the game is for each player to arrange three of his/her game pieces in a line or row termed a Mill, whenever a player makes a Mill that player may then remove one of his/her opponents' game pieces from the playing surface. The winner of the game is the player who captures the most game pieces from his/her opponent.

Previously the Mill game was played by drawing or outlining a temporary game layout, which consists of three concentric rectangles, in sand or on the ground. Even though, the idea or general principles of a game are known, a game typically does not attain a popular status until the game layout is fixed in or on a medium i.e., playing surface which is conducive to game play.

SUMMARY OF THE INVENTION

It is, therefore, one object of the present invention to provide a new fixed medium for use in playing the Mill game.

It is another object of the present invention to provide an aesthetic and tangible fixed medium having a game layout thereon for use in playing the Mill game.

To achieve the foregoing objects, the present invention is a Mill game including a game board having a playing surface and a plurality of game piece locations on the playing surface and arranged in a manner defining concentric rectangles. The Mill game also includes a plurality of lines interconnecting the game piece locations and a plurality of game pieces for movement along the lines between the game piece locations.

One advantage of the present invention is that a Mill game has an aesthetic and fixed tangible medium having the game layout thereon for use in playing the Mill game. Another advantage of the present invention is that the fixed tangible medium provides a decorative or conversation piece when not being used to play the Mill game, which promotes game play.

Other objects, features and advantages of the present invention will be readily appreciated as the same becomes better understood after reading the following description taken in conjunction with the accompanying drawings.

BRIEF DESCRIPTION OF THE DRAWINGS

FIG. 1 is a perspective view of a Mill game according to the present invention.

FIG. 2 is a top view of a first alternative embodiment of the Mill game of FIG. 1.

FIG. 3 is a top view of a second alternative embodiment of the Mill game of FIG. 1.

DESCRIPTION OF THE PREFERRED EMBODIMENT(S)

Referring now to FIG. 1, a Mill game 8, according to the present invention, is shown. The Mill game includes a fixed medium or game board 10 having a top or playing surface 12. The game board 10 is, preferably, rectangular in shape. The playing surface 12 includes a plurality of game piece locations 14 such as spherical indentations. The game piece locations 14 are arranged to form three concentric rectangles 16 on the playing surface 12 of the game board 10. The playing surface 12 further includes a series of lines 18 interconnecting the game piece locations 14 and further outlining and defining the rectangles 16. The lines 18 interconnecting the game piece locations 14 are either burned or silkscreened into the playing surface 12. The three concentric rectangles 16 are centered about a center point 20 of the game board 10. The game piece locations 14 are located, one at each corner of each of the three concentric rectangles 16 and one at each midpoint of the sides of each of the concentric rectangles 16. Each of the game piece locations 14 defines a discreet position at which a game piece 22, such as a marble, although other suitable objects such as pegs, carved figures, etc. may be used, is placed. The lines 18 define pathways for movement of the game pieces 22 on the playing surface 12.

The playing surface 12 further includes storage areas 24 such as troughs or channels extending along opposite edges of the playing surface 12. The storage areas 24 are used to store the game pieces 22 once they are removed from the playing surface 12. Each storage area 24 may also include a divider (not shown) to divide the storage area 24 into two separate and discreet sections for use in differentiating between those game pieces 22 removed from the playing surface 12 as a result of an opponent's Mill and those game pieces which have yet to be placed on the playing surface 12. The game board 10 has a bottom surface 26 with a key slot orifice (128 in FIG. 2) for use in hanging the game board 10 when not being played. The bottom surface 26 of the game board 10 also includes four foot or rest pads 30 to prevent marring or scratching of a support surface on which the game board 12 is placed.

Preferably, the game board 10 is made of a rigid material such as wood although other suitable materials such as plastic, marble, etc. may be used. The game board 10 also includes rounded edges although other shaped edges such as square, routered, etc., may be used.

In operation, the Mill game 8 is played in the following manner. Each player starts with nine (9) game pieces 22, illustrated herein as marbles. Player one places a game piece 22 on any one of the unoccupied game piece locations 14 on the playing surface 12 of the game board 10. Player two then places a game piece 22 anywhere on the playing surface 12, in any one of the unoccupied game piece locations 14. Each player will continue to place one of his/her game pieces 22 onto the playing surface 12 in an alternating manner until all of the game pieces 22 have been placed on playing surface 12. While placing game pieces 22 on the playing surface 12, the strategy is to create a mill or stop your opponent from creating a mill, identified as 32. A mill 32 occurs when three of a player's game pieces 22 are placed consecutively in a line on the playing surface 12. When a player makes a mill 32, the player is allowed to remove one of the opponent's game pieces 22 which is not in a mill 32. However, if the player makes two mills 32 simultaneously when placing game pieces 22, the player is allowed to remove two of the opponent's game pieces 22 which are not in a mill 32. If all of the opponent's game pieces 22 are in mills 32, the player making the new mill cannot remove an opponent's game piece 22. Once a game piece 22 is removed from the playing surface 12, it is forever removed and cannot be replaced. At this point in the game, the game pieces 22 may only be moved from one game piece location 14 to an adjacent game piece location 14 along the lines 18.

A player may break up a mill 32 with one move and then recreate his/her mill 32 with the next move in order to remove a game piece 22 of the opponent. If the player makes two mills 32 simultaneously when moving game pieces 22, the player is allowed to remove two of the opponent's game pieces 22 which are not in a mill 32. The game continues until one or both player(s) has only three game pieces 22 left on the playing surface 12. When a player has only three game pieces 22 left, the rule requiring that a player may only move to an adjacent game piece location 14 along the lines 18 on the playing surface 12 is no longer valid and the player can move his/her game pieces 22 to any game piece location 14 on the playing surface 12. If a player has an existing mill 32 on the playing surface 12 and the second player puts his/her three game pieces 22 in a mill 32, the second player, in making the mill 32, cannot remove a game piece 22 of the first player. A player must move a game piece 22 during each of his/her turns. The player who has captured the most game pieces 22 from his/her opponent is the winner.

FIGS. 2 and 3 illustrate alternative embodiments 108 and 208 of the Mill game 8, respectively, of the present invention. Like parts of the game board 10 have like numbers increased by one hundred (100) and two hundred (200), respectively. FIG. 2 illustrates a four player game board 110. The four player game board 110 has a layout including one game piece location 114 located at the midpoint of the short sides of each of the three concentric rectangles 116 and two game piece locations 114 located equidistant from the midpoint of the long sides of the three concentric rectangles 116. FIG. 3 illustrates a six player game board 210. The six player game board 210 has a layout including one game piece location 214 located at the midpoint of each of the short sides of the three concentric rectangles 216 and three game piece locations 214, one located at the midpoint and the remaining two located at points equidistant from the midpoint of each of the long sides of the three concentric rectangles 216. The operation and playing of the Mill game 108 and 208 is similar to that described for the Mill game 8 of FIG. 1.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A Mill game comprising:

a game board having a playing surface;

a plurality of game piece locations on said playing surface, said game piece locations arranged on said playing surface in a manner defining concentric rectangles;

a plurality of lines interconnecting said game piece locations;

a plurality of game pieces for movement along said lines between said game piece locations;

each of said rectangles including one of said game piece locations at each corner of said rectangles and at least one of said game piece locations on each side of said rectangles;

said game piece locations being spherically shaped indentations; and said rectangles including at least two of said game piece locations on two sides, said at least two of said game piece locations located equidistant from a midpoint of the two sides of said rectangles.

2. A Mill game comprising:

a game board having a playing surface;

a plurality of game piece locations on said playing surface, said game piece locations arranged on said playing surface in a manner defining concentric rectangles;

a plurality of lines interconnecting said game piece locations;

a plurality of game pieces for movement along said lines between said game piece locations;

each of said rectangles including one of said game piece locations at each corner of said rectangles and at least one of said game piece locations on each side of said rectangles;

said game piece locations being spherically shaped indentations; and said rectangles including at least three of said game piece locations on two sides, said game piece locations located such that one of said game piece locations is located at the midpoint of the two sides of said rectangles and the other two of said game piece locations are placed equidistant from a midpoint of the sides of said rectangles.

* * * * *